United States Patent [19]

Fitch et al.

[11] 4,364,752

[45] Dec. 21, 1982

[54] ELECTROSTATIC PRECIPITATOR APPARATUS HAVING AN IMPROVED ION GENERATING MEANS

[76] Inventors: Richard A. Fitch, 2340 Calle de Oro, La Jolla, Calif. 92037; Joseph T. Roe, 5853 Valley Forge Rd., Houston, Tex. 77057

[21] Appl. No.: 243,487

[22] Filed: Mar. 13, 1981

[51] Int. Cl.[3] ..... B03C 3/00

[52] U.S. Cl. ..... 55/138; 55/139; 55/152; 55/154; 361/230

[58] Field of Search ..... 55/152, 154, 136–138, 55/139; 361/225–235

[56] References Cited

U.S. PATENT DOCUMENTS

| | | | |
|---|---|---|---|
| 617,618 | 1/1899 | Thwaite . | |
| 1,357,201 | 10/1920 | Nesbit . | |
| 1,357,466 | 11/1920 | Moller . | |
| 2,142,128 | 1/1939 | Hoss et al. . | |
| 2,199,390 | 5/1940 | Anderson . | |
| 2,377,391 | 6/1945 | White . | |
| 2,440,455 | 4/1948 | White . | |
| 3,120,626 | 2/1964 | Schweriner . | |
| 3,178,930 | 4/1965 | Moore et al. . | |
| 3,550,852 | 12/1970 | Wallis . | |
| 4,071,334 | 1/1978 | Kolb et al. . | |
| 4,126,434 | 11/1978 | Keiichi | 55/152 |
| 4,222,748 | 9/1980 | Argo et al. | 55/138 |
| 4,236,900 | 12/1980 | Fitch et al. . | |
| 4,265,641 | 5/1981 | Natarajan | 55/152 |

*Primary Examiner*—Bernard Nozick

*Attorney, Agent, or Firm*—Fitch, Even, Tabin, Flannery & Welsh

[57] ABSTRACT

A system is disclosed for removing particles from a gaseous medium and comprises an upstream precipitating stage followed by a downstream precipitating stage having one or more electrically charged shells with corona discharge apparatuses therein which produce ions at predictable, generally uniformly spaced locations. The shells have flat sides and openings at the upstream and downstream ends so as to permit a portion of the gaseous medium to flow through the interior of the shell and flat sides which act as collecting means. The flat sides of the shells are generally parallel to collecting side plates for providing a uniform electric field between the shells and collecting plates, the sides of the shells having openings to permit the passage of ions generated in the interior of the shell.

32 Claims, 7 Drawing Figures

Fig. 4.
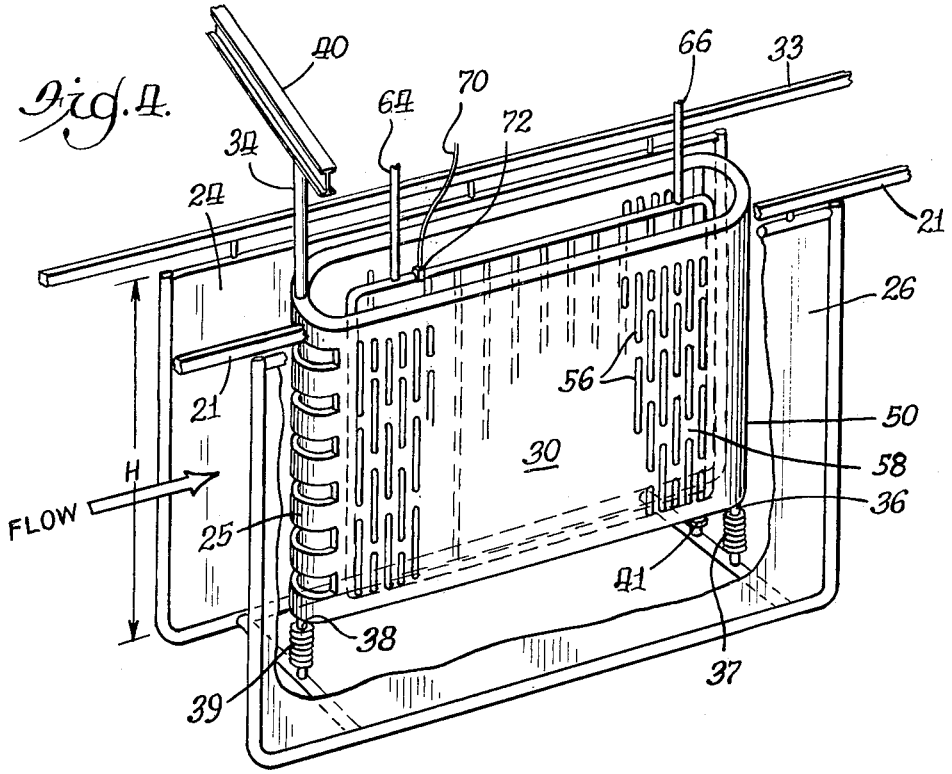
Fig. 5.
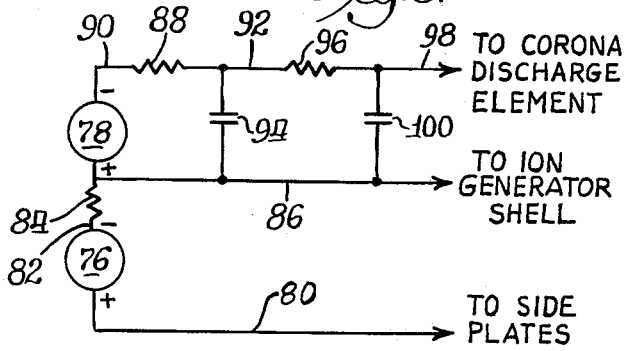
Fig. 6.
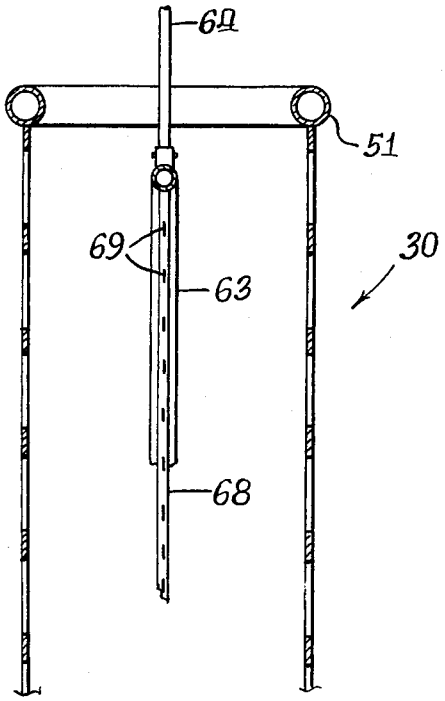
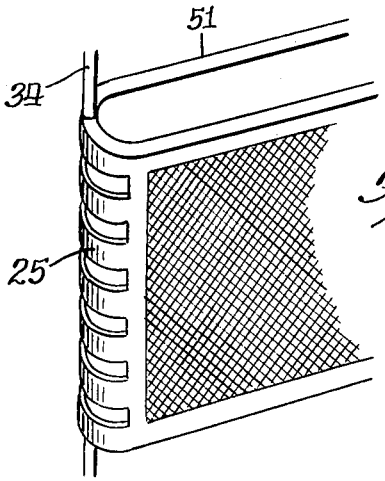
Fig. 7.

ELECTROSTATIC PRECIPITATOR APPARATUS HAVING AN IMPROVED ION GENERATING MEANS

The present invention generally relates to an electrical precipitation apparatus for removing solid or other particles from a gaseous medium, such as industrial flue gases and other effluents.

All electrical precipitators depend for their function on the basic principle that electrically charged particles experience a force when subjected to an electric field. This force effectively causes the particles to "settle" out of the electric field in much the same manner as dust settles in the gravitational field. The virtue of electrical precipitation lies in the relative magnitude of the electrical force compared with the gravitational force (a factor of 100, for example, in the case of a 5 micron particle) so that the size of the settling chamber becomes manageably small.

Electrostatic precipitators have been among the many devices that have been developed for removing air-borne dust and other particles from a gaseous medium prior to the discharge of the medium into the atmosphere. These precipitators typically remove particles from the gaseous medium by passing it through a chamber in which ions are generated by a corona discharge. The ions collide and combine with the dust particles and electrically charge the particles as they pass through the chamber. Additionally, the electric field associated with the generation of ions within the collection chamber exerts a force upon the charged dust particles and drives them toward a collection plate or electrode that has an applied potential of opposite polarity relative to the charged particles. Desirably, most dust particles will become charged and collected on the collection plate so that the gaseous medium that is discharged into the atmosphere will have been well cleaned.

In the operation of most prior art electrostatic precipitators, as well as the invention described herein, dust particles which combine with ions take on the same charge as the ions. When a dust particle becomes charged and has the same charge as the ion, other ions of the same sign are repelled by it, thereby making it more difficult for other ions of the same sign to add electrical charges to the particle. For a given electrostatic field strength and a given size of dust particle there will be a limit beyond which the dust particle will no longer accept additional charges by field charging. A maximum charge which can be acquired by dust particles in field charging is $N_s$ given by the equation:

$$N_s = \frac{52\epsilon\, ED^2}{\epsilon + 2}$$

wherein $N_s$ is the saturation number of electronic charges, E is the applied electric field in kV per centimeter, D is the particle diameter in microns and $\epsilon$ is the particle dielectric constant.

The above equation indicates the charge limit of both large and small diameter dust particles is essentially a function of the electric field strength. It is apparent that it is desirable to increase the electric field to the point at which most particles will be sufficiently charged so that they will be collected on a collection plate or electrode and not be expelled into the atmosphere, it being understood that it is extremely difficult to collect all particles, due to turbulence and other factors. However, in conventional electrostatic precipitators, the average electric field within the collection chamber is generally limited to about 4 kV/cm because of the manner in which the ions are generated. Typically such precipitators include a corona discharge device within the collection chamber for generating the ions with the corona discharge being produced by a high potential applied to an electrode such as a thin wire. As a result, the collection chamber generally experiences a highly nonuniform electric field that has a low average value. The low average value for the electric field within the collection chamber is undesirable because it limits the degree to which particles within the chamber can be effectively charged and reduces their drift velocity towards the collecting plates.

However, U.S. Patents to Alan C. Kolb and James E. Drummond, U.S. Pat. Nos. 4,071,334 and 4,070,157 entitled "A Method and Apparatus for Precipitating Particles from a Gaseous Effluent", which are assigned to the same assignee as the present invention, each disclose a precipitation apparatus which has a generally high uniform electric field within the charging chamber and ions generated by independent means, such as a thermionic ion emitter or an electron beam generator, the latter of which is sealed from the main charging chamber and directs a beam of electrons into the charging chamber for ionizing molecules therein and for charging the dust particles within the gaseous effluent.

The independent generation of the ions by means other than that which produces the electric field enables a stronger, more uniform electric field to be established within the apparatus and permits independent control over the ions that are generated to produce the charging of the particles of the effluent that is to be cleaned. While the apparatus disclosed in the above-referenced Kolb and Drummond patents represents significant improvements over the type of apparatus that utilizes a thin wire or the like for creating both the corona discharge and establishing the electric field in the device, such apparatus charges the particles and also subjects the charged particles to an electric field to force them onto a collector plate in the same chamber. The electrical force, F, is directly proportional to the charge of the particle and the strength of the collecting field, $E_{coll}$, and the charge on the particle is directly proportional to the strength of the field in which the particle is charged, $E_{ch}$. Thus the force, and hence the effectiveness of the system, is proportional to the product of the two field strengths, i.e., $$F \alpha E_{coll} \times E_{ch}.$$

While it is desirable to make both of these fields as high as possible, there are two distinct problems that are generally experienced; the charging field must be suffused with a supply of ions to effect charging and a high field at the collector plate tends to pull the dust particles off of the plate and reentrain them. This is due to the fact that after the dust particle lands, it gives up its charge and is recharged with the opposite polarity so that it acquires a reverse force. In a conventional wire/-plate precipitator apparatus, both problems are solved simultaneously by the corona discharge wire which provides the ions for charging the air-borne particles, and also provides a continuous supply of ions at the collected dust layer to inhibit reentrainment by maintaining a charge of the original sign, which may be referred to as the pin-on current. However, the disadvantage of the arrangement is that of experiencing reduced electric fields, both $E_{ch}$ and $E_{coll}$, because the corona process necessitates a highly nonuniform field and a nonuniform field exhibits spark breakdown at lower average field strengths than a uniform field.

Spark breakdown generally sets the limit of the maximum practical electric field in that, as the field is increased, the probability of sparking also increases so that at some point sporadic sparking sets in, at a rate that increases as the field continues to increase, until it becomes so frequent that the time-average field declines or the power demands of the apparatus become prohibitive. Generally, the electric field of modern conventional electrostatic precipitators is kept at a point where sparking occurs at the rate of about 20 sparks per minute.

In a perfectly uniform electric field, under clean conditions, at room temperature, and sea level pressure, with only natural background ionization, the breakdown limit is generally well recognized to be at about 30 kV/cm. Many factors, including the increase in temperature, the reduction in pressure, the presence of dirt, the increased ion densities and increased nonuniformity, all lower the breakdown strength as well as increase its spread. A typical precipitator condition comprises a temperature of about 350° F., 15 to 21 inches (water) negative pressure and the presence of dust, all of which are unavoidable and which lower the uniform-field, ion-free breakdown to a level of about 17 kV/cm. The addition of ions and the intrinsic field nonuniformity of a conventional wire/plate precipitator lower the mean field strength still further to a level of about 4–5 kV/cm.

The use of a single stage for charging and collecting the particles has been generally felt to be superior to two stage arrangements which charge the particles in a first corona stage and collect them in a second non-corona stage, probably because of the problem of back corona in the first stage and dust reentrainment in the second stage which can be extensive for prior two-stage arrangements (e.g. see pp. 34–35 in the textbook "Industrial Electrostatic Precipitation" by H. J. White, 1963).

In U.S. Pat. No. 4,236,900 to Richard A. Fitch, James E. Drummond, and Alfred A. Mondelli, issued Dec. 2, 1980, it was demonstrated how a substantial improvement in field strength can be achieved in an ion-beam-generator precipitator system, by the combination of reduced dust loading with an upstream stage electrostatic precipitator followed by a downstream stage which incorporates an ion generating means. The ion generating means included the screening of nonuniform ions of a corona field from the main collection regions by means of perforated plates to permit the supply of unipolar ions to the collection regions. In the arrangements described hitherto, the perforated plates of the ion beam generator has been configured in the form of side walls of a substantially closed shell. This has the virtue of providing the closest approximation to the ideal, uniform-field arrangement. It also possesses a desirable structural rigidity, and, to a large extent, screens the corona region inside the shell from dust fouling. It does, however, have certain disadvantages. Although dust fouling is reduced, dust does eventually build up, and the closed nature of the shell compounds the difficulty of rapping it off the electrodes and removing it from the shell. Also, accommodating the necessary supporting insulators inside the shell poses more design problems than do the external supports typical of conventional electrostatic precipitators. Further, the ion beam generator shell obstructs part of the gas passage, thereby forcing an increase in overall size of the precipitator if the original gas velocity is to be maintained.

From the foregoing discussion of the many phenomena that need to be taken into consideration in removing particles from a gaseous effluent, together with the many problems that are experienced with conventional electrostatic precipitators, including single-stage and two-stage arrangements, it should be apparent that a precipitating apparatus that operates to remove particles with the efficiency that may be required by governmental regulations has heretofore been difficult to attain at a reasonable cost and using a reasonable amount of physical space.

The present invention can be broadly summarized as a system in which multiple stages are utilized, with each stage performing a primary function and the multiple stages operating synergistically to provide significantly improved overall results. The present invention may not only utilize an upstream stage comprising a generally conventional electrostatic precipitator apparatus of the type utilizing a series of corona discharge wires and accompanying parallel collector plates, but the invention utilizes an improved ion generating means with an open-shell structure in the downstream stage. Use is made of the inside of the open-shell structured ion beam generator for precipitation inside the generator as well as using the ion beam generator to supply unipolar ions to the dirty gas flowing outside the ion beam generator enables the ion beam generator to function simultaneously as a parallel electrostatic precipitator to increase the efficiency of the system yet reduce its size.

Accordingly, it is an object of the present invention to provide an improved multistage precipitating apparatus which utilizes an improved, open-structured ion generating means for introducing unipolar ions into the gaseous effluent and for generating a generally uniform electric field in the region between the collector plate structure and the side walls of the ion generating means where the open structure facilitates the cleaning, hanging, and positioning of corona electrodes and removal of particulates deposited inside the open ion generating means.

A further object of the present invention is to provide an open-shell ion generating means to permit the partial flow of effluent gas through the ion beam generator to decrease the overall gas velocity without increasing the overall size of the precipitator and permit the division of a gas stream passing through the ion generating means and between the side wall of the ion generating means and outer collector plates in proportion to the relative collection efficiencies of the ion generating means and of the electrostatic precipitator.

Still another object of the present invention is to provide an improved precipitating apparatus that includes an ion generating means which simultaneously functions as an electrostatic precipitator to maximize the benefit from the ion beam generator and enable the reduction of the entire size of the system.

Other objects and advantages will become apparent upon reading the following detailed description while referring to the attached drawings, in which:

FIG. 4 is an enlarged perspective view of the open-shell structure of the ion generating means of the apparatus of the present invention between collecting plates, and is shown with portions removed and other portions broken away;

FIG. 5 is a schematic diagram of an exemplary electrical circuit that may be used to charge the corona discharge means as well as the outer shell of the ion generating means of the present invention;

FIG. 6 is an enlarged view of a portion of the side of the apparatus shown in FIG. 2;

FIG. 7 is an alternate embodiment showing an ion generating means with mesh side walls.

Figure 1:
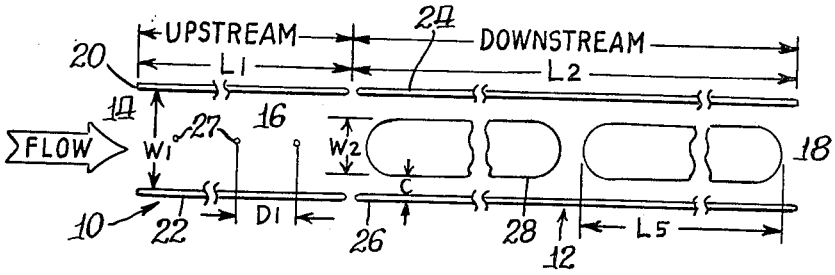
FIG. 1 is a simplified schematic plan view of precipitating apparatus embodying the present invention.

Turning now to the drawings, and referring particularly to FIG. 1, apparatus embodying the present invention is shown in a simplified schematic top plan view as comprising an upstream region indicated generally at 10 and a downstream region indicated generally at 12, with the upstream region having a length L1 and the downstream region a length L2. In the upstream region, the gaseous medium is cleaned by an electrostatic precipitator. In the downstream region the gaseous medium is cleaned by an ion beam generator simultaneously acting as an electrostatic precipitator. The gaseous medium enters an inlet 14 shown at the left of the drawing with the flow being to the right as shown by the arrow. The medium passes through the inlet and into the flow channel indicated generally at 16 which extends the entire length of the apparatus to the outlet indicated at 18. The portion of the apparatus shown in FIG. 1 exemplifies but a single channel within a precipitating apparatus and a typical commercial apparatus would have a large number of such channels arranged parallel to one another, with the side plates of one channel being common to the next adjacent channels.

More specifically, the upstream region has side collecting plates 20 and 22 and the downstream region has side collecting plates 24 and 26 all of which are generally flat. The collecting plates 20 and 24 are preferably coplanar as are collecting plates 22 and 26 so that the width of the channel is generally constant throughout its length. While it is convenient to have the collecting plates of the upstream region generally coplanar with the respective collecting plates of the downstream region, it should be understood that this relationship is not necessary. However, since the flow path in the downstream region is not restricted despite the presence of an ion generating means, there may be a substantially one-to-one relation of channels between the upstream and downstream regions. Further, because of the action of the downstream ion beam generator as an electrostatic precipitator the efficiency of the precipitating system is improved by making use of the potential for precipitation inside the ion beam generator which also supplies unipolar ions to the main body of dirty effluent gas which flows through the channel outside the ion beam generator. The collecting plates 20 and 24, as well as collecting plates 22 and 26 may have a space between them as shown or they may be abutting, particularly if they are provided with the same potential which is preferably ground potential as will be described herein.

In a commercial apparatus in the precipitation of fly ash, the apparatus may have an overall height between about 16 feet to about 50 feet, an overall length of about 5 feet to over 50 feet and a sufficient number of channels 16 to provide an overall width up to 60 feet or more, with each of the channels having a width W1 of approximately 8–15 inches. While a commercial fly ash precipitator may have the above-mentioned dimensions, in other applications the dimensions of the apparatus may be considerably altered. In fact, the apparatus may be reduced in scale to the extent that it may be applicable to clean air in a home and may fit within a window of a house or apartment, for example.

As the medium passes through the upstream region 10, its flow is only slightly obstructed by the discharge wires 27, but in the downstream region the shell 30 of the ion generating means 28 can present a significant obstruction. If the shell is closed, the velocity of the medium must increase in passing through the restricted region of pathways between the shell and the collecting plates 24 and 26. If the shell is fully open, the obstruction is again small but approximately one-third of the gas flows in the region between the discharge wires and the shell. This region behaves as a conventional electrostatic precipitator with a collection efficiency less than one-half of that of the ion-beam region between the shell and the collecting plate. In order to achieve the maximum combined efficiency, therefore, the velocity is reduced inside the shell by baffles 25 in front of the upstream opening to the shell in such a way as to divide the effluent gas into fractions flowing inside the shell and outside the shell in proportion to the specific collection efficiencies of the two regions. Since gas velocity is a critical factor in the collection efficiency, with the closed shell the overall size of the precipitator may have to be increased to keep the velocity increase within acceptable limits. With the open-shell design, the baffles cause a moderate increase in flow velocity which can generally be accommodated without increasing the overall size of the precipitator.

Within the upstream region are one or more vertically oriented conventional corona discharge wires 27 which are charged relative to the collecting plates 20 and 22 and provide a corona discharge in the upstream region that charges the particles of the gaseous medium entering the upstream region. The distance D1 between adjacent corona discharge wires is preferably about 6 to 12 inches and the wires are preferably centrally located within the channel 16 so that the distance between the wires and each of the side collecting plates 20 and 22 is about 5 inches, given the width W1 of about 10 inches. The corona discharge wires 27 are preferably charged to provide a mean electric field strength of about 4 kV/cm and the overall length L1 of the upstream region may be from about 3 to about 10 feet in a typical fly ash precipitating apparatus. The discharge wires are fully exposed to the corrosive environment of the medium and should therefore be of a size that will permit them to survive without breaking and have a commercially acceptable life, i.e., they should preferably have a diameter of about 1/10 to about $\frac{1}{8}$ inch. Alternatively, an arrangement of barbed strips supported by a rigid frame can be used. The purpose of the upstream region is to electrostatically precipitate the larger particles, i.e., those particles having a diameter larger than about 10 microns, although it is the particles above about 50 microns that are of prime concern in this region. Another important aspect is to remove the bulk of the particles which would otherwise produce space charge field distortion and thereby lower the average field and which would also quickly build a heavy layer of dust in the downstream region were it not removed in the upstream region. The desirability for this derives from the fact that electrical as well as wind reentrainment becomes a more severe problem as the dust layer becomes heavier and builds up on side collecting plates 24 and 26 of the downstream region 12. Increased reentrainment due to wind occurs in the downstream region because the flow velocity is somewhat greater in the downstream region due to the presence of the ion generating means. Also, as the dust particles accumulate, the cross-sectional area of the channel is reduced, which further increases the flow velocity and increases the tendency for the particles to reentrain. This upstream removal of the larger particles is also believed to be helpful for the reason that they are more susceptible to bouncing through the precipitator apparatus and tend to create havoc with the accumulated precipitated dust layer upon impact. When they strike the surface they will dislodge other particles that have accumulated on the side collection plates 24 and 26 and will dislodge both large and small particles alike. By utilizing the upstream region to precipitate most of the larger particles, this undesirable effect can be minimized.

The present invention may be modified with alternative methods of removing particles upstream of the electrostatic precipitator. A gravitational precipitator, a cyclone precipitating device, or even an ion beam generating device may be placed before or upstream of the electrostatic precipitator and the system of this invention. If any ion beam generator is used it should be charged to a lower potential to remove large particles. Such alternative methods are disclosed in U.S. Pat. No. 4,236,900 to Richard A. Fitch, James E. Drummond, and Alfred A. Mondelli, issued Dec. 2, 1980, which is hereby incorporated by reference.

It should be appreciated that in typical fly ash precipitators, for example, the mean electric field strength in the upstream region is typically about 4 kV/cm and that the electric field in the downstream region is significantly higher. The field strength in the downstream region may be in the range of about 6 to about 12 kV/cm which would provide a much stronger influence on such larger particles than is present in the upstream region.

As is apparent from viewing FIG. 1, the collecting region 12 is shown to have two ion generating means 28 in series located centrally within the channel 16. As will be hereinafter described in detail, the ion generating means may comprise a single structure rather than the two in-line structures 28, but for reasons of weight and ease of fabrication and installation, the downstream region may comprise several ion generating means of lengths within the range of about 2 to about 12 feet. The requisite number of them can then be placed in the downstream region to provide the necessary overall length L2 of the downstream region, which may be 10 feet or more. In the event the height of the collecting region approaches 30 feet, then two or more of the ion generating means 28 of correspondingly shorter height may be provided in the apparatus. The width W2 of the ion generating means is preferably as small as possible consistent with achieving the ion current density appropriate to the particular dust to be collected and the action of the ion generating means as an electrostatic precipitator. In the collection of fly ash the width W2 may be about 3 inches. With a width W2 of about 3 inches, in an overall channel width W1 of about 11 inches, the spacing between the side walls of the ion generating means 28 and the collecting plates 24 and 26 will be about 4 inches, generally in the range of between about 3 to about 6 inches, designated as the distance c in FIG. 1 as well as FIG. 3. The above-mentioned dimensions are generally applicable for fly ash precipitators. For other applications, the dimensions may be larger or considerably smaller as previously mentioned.

The outer surface of the ion generating means 28 which has a high voltage relative to the collecting side plates 24 and 26 is shown to be smooth in that it has no sharp edges that can provide electric field enhancement, thereby providing the high, generally uniform, electric field between the outer surface of the ion generating means and the collecting side plates previously briefly discussed. For a typical power station which emits flue gas at about 350° F. the uniform electric field between the ion generating means 28 and the side collecting plates 24 and 26 is preferably at least about 6 kV/cm and may approach 8 kV/cm without experiencing significant electrical breakdown. A problem that is often experienced is the phenomenon of back corona. The electric field as well as the charging current may be further increased if means are provided for reducing back corona, some of which will be described hereinafter. By having the outer surface of the ion generating means smooth without sharp corners, i.e., providing a radius to all openings that are present, the average field strength within the channel can substantially approach the peak field strength of the apparatus as is desired.

It should also be understood that the collecting plates should be smooth and without sharp corners anywhere opposing the ion generating means. In this regard, it is noted that the minimum distance is the distance c between the surface of the ion generating means and the collecting plates 24 and 26 and that the outer surface of the generating means 28 and the collecting plates comprise generally parallel planes. The field between the two planes is generally uniform and the average field strength approaches the maximum field strength within the apparatus.

Figure 2:
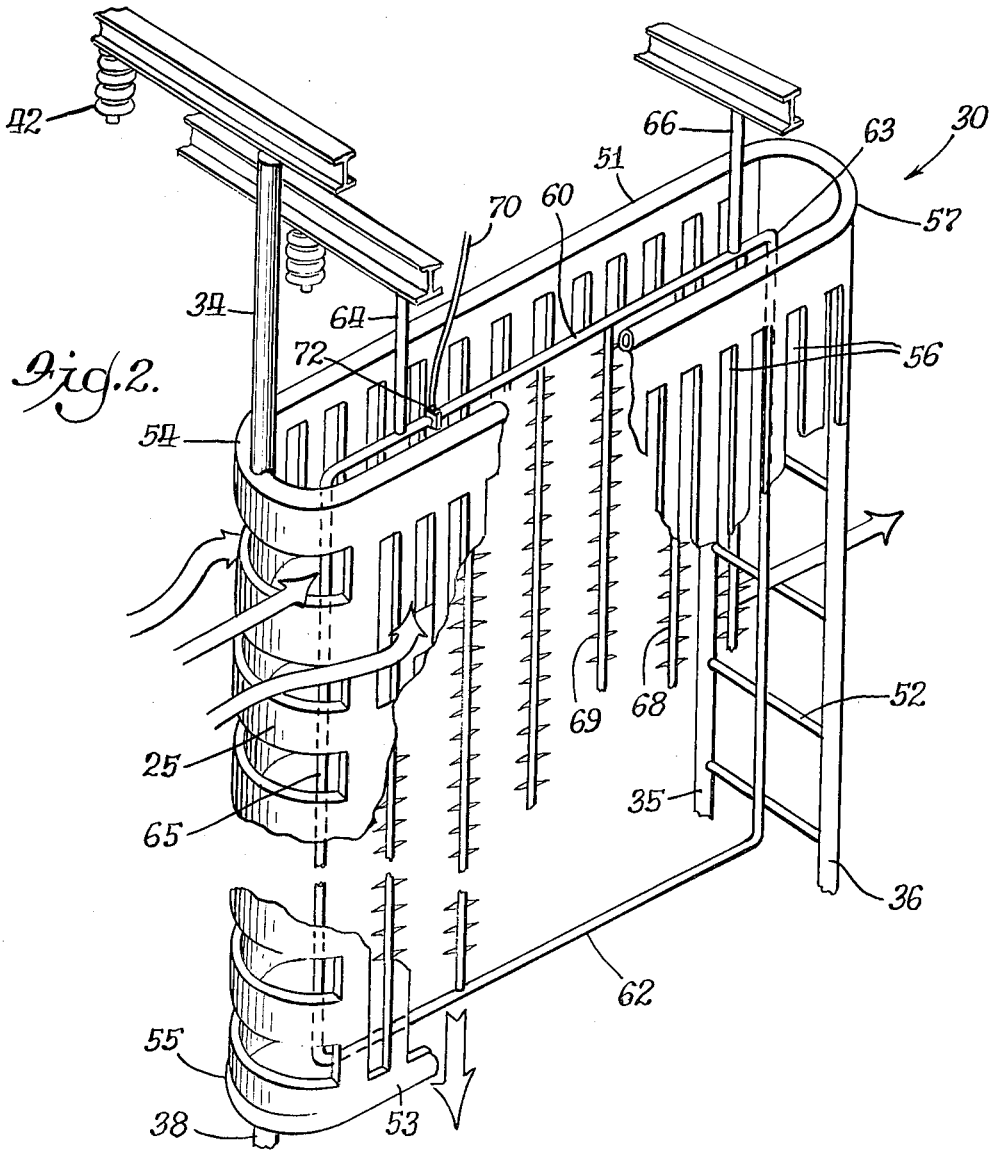
FIG. 2 is a perspective view of the open-shell structure of the ion generating means of the apparatus of the present invention which is shown with portions broken away.

With respect to the construction of the ion generating means 28, reference is made to the perspective view of FIG. 4 which also illustrates the side collecting plates 24 and 26 together with the supporting structure for the generating means. Reference also is made to FIG. 2 which is a perspective view illustrating a portion of the ion generating means. The ion generating means 28 has a shell 30 with flat parallel side walls, made of a structurally rigid electrically conductive material and which is preferably charged to a negative potential relative to the side collecting plates 24 and 26 and will hereinafter often be referred to as a cathode. The collecting plates 24 and 26 comprise the plate structure, and are hung by means such as a bolt from beams 33 and 21 which are above and parallel to the plates. The collecting plates are preferably positively charged relative to the cathode potential, and are preferably at ground potential. The collecting plates cooperate with the shell 30 to provide a uniform strong electric field in the channel between the shell 30 and the collecting plates 24 and 26, through which the gaseous medium flows as previously described. The interior surfaces of shell 30 also act as collecting areas for the action of the ion generating means as an electrostatic precipitator. Hence negative ions are drawn toward the region between shell and collector plates 24 and 26 to negatively charge particles and collect them on collector plates 24 and 26. Positively charged particles are collected on exterior surface of the shell. While the cathode shell 30 is described herein as being negatively charged with respect to the plate structure, i.e., the collecting plates 24 and 26, it should be understood that the apparatus can be operated with the outer shell positively charged with respect to the plate structure, provided that the corona discharge apparatus located within the shell is also postively charged. It is desirable that the plate structure be maintained at ground potential regardless of whether the corona discharge apparatus and the shell are positively or negatively charged with respect to the plate structure because it is easily accomplished and permits attachment to the main structural framework of the apparatus. The gaseous medium carrying particles that are to be collected therefrom generally passes in the direction shown by the arrows in FIGS. 1, 2 and 3, i.e., to the right as shown.

The apparatus shown in FIG. 4 may have a height H of 16 feet or more as previously mentioned with a plurality of separate channels, one of which is shown in FIGS. 1–4. The lower end is open as shown so that the side collecting plates 24 and 26 can be vibrated or rapped to remove the accumulated dust that has been precipitated out of the gaseous medium during operation of the apparatus. The shell 30 has an upper support 34 as well as lower supports 35,36,38 for structurally supporting the ion generating means 28 within the channel 16. The upper support 34 is attached to support member 40 which extends across several channels and is connected to other ion generating means 28 in adjacent channels. The end of the member 40 is suitably connected to insulator 42 which is preferably made of ceramic and which electrically isolates the member 40 from the remainder of the apparatus.

Similarly, the structural supports 35,36 and 38 are attached to preferably ceramic insulators 41, 37, and 39 that are also suitably connected to the main structure of the apparatus. The net result of the use of the insulators is to permit the support member 40, supports 34, 35, 36 and 38 as well as the shell 30 to be charged to the desired potential that is preferably negative relative to the collecting plates 24 and 26. As is best shown in FIG. 2, the upstream end of the ion generating means is formed from sheet metal or the like which is outwardly curved with portions cut away to provide a vertically extending trough-like end section having uniformly curved baffles 25 and open areas at the left end or upstream portion of the ion generating means 28. The right end or downstream portion 50 of the ion generating means is open for unrestricted air flow through the ion generating means. Ladder type cross bracing 52 between supports 35 and 36 add strength and stability to the shell 30. The upper and lower ends of the shell are open and access to the interior of the shell is facilitated. The upper and lower edges of the shell 30 are provided with a smooth curved surface as at 51 and 53 such as 1-inch pipe sections or the like to prevent sparking. The upper and lower corners 54 and 55 of the left end or upstream portion of the shell as well as the upper corner 57 of the right end or downstream portion of the shell are provided with a uniform curvature. The surface shell 30 opposed to collecting plates 24 and 26 is shown to be generally solid or closed, except for the presence of a plurality of vertical slots 56 which extend in vertical rows substantially the entire height of the ion generating means 28. The slots have a width of about ½ inch and can be interrupted or separated by web portions 58 of about 2 inches which are provided for the purpose of imparting structural rigidity to the shell 30. As shown, the web portions 58 are offset in adjacent rows for the purpose of insuring that the medium passing by the slots is subjected to an adequate supply of ions which pass from the interior through the slots into the channel. The orientation of the rows of slots is preferably generally vertical as shown in FIGS. 2 and 4, and transverse to the flow of the gaseous medium through the channel 16. This assures that substantially all of the medium is subjected to the ions being injected into the channel as is desired. It should be understood that while the rows of slots are preferably vertically aligned, they may be also oriented at an angle relative to vertical if desired. It should also be understood that while the openings are preferably in the form of elongated slots, such surface of the shell may be in the form of a mesh or screen as indicated in FIG. 7. The openings can also be circular or some other shape and arranged in rows so that the openings are adjacent the corona discharge members which will be hereinafter described. An important consideration is that the openings, whether in the form of elongated slots, circles, mesh or the like be of a size large enough to pass an adequate supply of ions therethrough, while not significantly disrupting the uniformity of the electric field in the channel.

To generate the ions in the interior of the shell 30, a structure for producing corona discharge is provided and generally comprises upper and lower cylindrical support members 60 and 62. These cylindrical support members are suitably connected to electrical supports 64 and 66 which electrically isolate the corona discharge structure from the shell to permit the potential difference to be applied to the two structures. The support members 60 and 62 are opposed and face one another. A plurality of corona discharge elements 68 extend between the two supports. Each element has outwardly extending spikes 69 the ends of which are preferably located in the center of a row of slots 56 so as to provide a supply of ions through corona discharge, the ions being injected into the gaseous effluent through the slots, or through the openings in a mesh in the event a mesh is utilized. Cylindrical side support members 63 and 65 are substantially orthogonal to support members 60 and 62 and are attached thereto to provide a frame for corona discharge elements 68. Because the top and bottom of shell 30 is open this entire frame and the corona discharge elements can be removed from the shell for cleaning. Further because of its function as a collector plate the shell can also be removed, rapped or vibrated for cleaning with the open structure of the shell facilitating such cleaning.

As best shown in FIG. 2, the corona discharge elements 68 preferably comprise conducting rods with an outer diameter in the range of about ¼ inch to about ½ inch. These rods have outwardly extending spikes 69 pointing up and downstream, with the spikes placed to provide the desired corona discharge pattern. The spikes should not be opposite web portions 58 of shell 30 because ions produced at such locations would not reach the channel because of web 58 and power would be wasted. The elements can also be thin wires, though wires have disadvantages in large systems. An advantage of rods with spikes is that the sharp radius at the edge of the spike is more conducive to generating corona discharge at a selected position than the bigger radius of a wire of comparable strength and longevity in the corrosive environment of the apparatus.

To charge the corona discharge apparatus and referring again to FIG. 2, an electrically insulated cable 70 is provided and is suitably connected to a source of potential (not shown). The cable extends to a suitable electrical connector 72 that is attached to the upper support 60 and thereby provides the potential to the corona discharge elements 68.

It is preferred that the corona discharge elements 68 have an applied potential that, for fly ash, is within the range of about 7 kV to about 20 kV and preferably about 12 kV relative to the shell 30 and that the shell 30 have a voltage level within the range of about 30 kV to about 60 kV and preferably about 50 kV with respect to the potential of the side plates 24 and 26. These voltages may be continuously controlled such as by a feedback loop so as to maintain the electric field within the channel 16 at an optimum level, i.e., as high as possible without experiencing excessive sparking or electrical breakdown or excessive back corona. The level of the field that is attainable within the channel 16 is a function of various conditions, such as the density of the particulates within the gaseous medium, the temperature of the medium and the chemical constituency of the gaseous medium. The voltage may be continuously controlled in the manner whereby an optimum sparking rate is experienced, e.g., between about 1 and 20 sparks per minute for a fly ash precipitator section having 100,000 square feet of collecting plate area, so that the efficiency of operation is maximized. In this regard, if the spark rate is below the desired level, the apparatus will neither charge nor collect the particles as well as it could. An excessive spark rate causes severe reentrainment, results in excessive power consumption, and reduces the time-average field. All of the latter conditions indicate less than optimum operating efficiency. The apparatus preferably controls the voltage level by increasing the potential applied to the shell 30 until voltage breakdown or an excessive spark rate is sensed, in which event the voltage is reduced, and slowly increased again while the potential difference between the corona electrodes and the shell is held generally constant.

With respect to the actual corona discharge that is produced in the apparatus, it is a highly local phenomenon that occurs at discrete points along the length of the discharge rod or wire and is highly dependent upon the voltage that is applied thereto. The phenomenon generally occurs as corona spots on the spikes 69 and the presence of a corona spot produces a space charge at that location. This simultaneously reduces the electric field adjacent the spot which discourages other corona discharging spots immediately adjacent that spot because the field has been reduced. The electric field lines that emanate from dark or noncorona producing regions of the strip or wire will define corresponding dark regions where they terminate on collecting plates 24 and 26. This is due to the fact that the ions effectively follow field lines and there can therefore only be ions on field lines that emanate from a corona discharging spot. However, the corona pattern, i.e., the intervals between the corona discharging spots, can be varied by changing the voltage. If the voltage is increased, the corona discharge spots become closer together and if it is decreased, they move farther apart. At some level of decreased voltage, the corona spots occur rather randomly and significant areas of the collecting plate are starved of pin-on current. Conversely, a high voltage produces a good ion-current coverage of the collecting plates 24 and 26; however, if the associated high current density immediately opposite the corona spots is too high, it can lead to back corona unless the dust layer is exceptionally conductive.

It should of course be appreciated that there will be no corona discharge between adjacent elements 68 because all of the elements are at the same potential. In addition to the advantage of using elements 68 with spikes to provide well defined corona discharge locations, the elements supported by support members 60 and 62 which are attached to prepositioned insulator supports eliminate the problem of aligning each element through its entire length so that all of the elements are maintained facing the slot as shown by the upper element 68 in FIG. 3.

Figure 3:
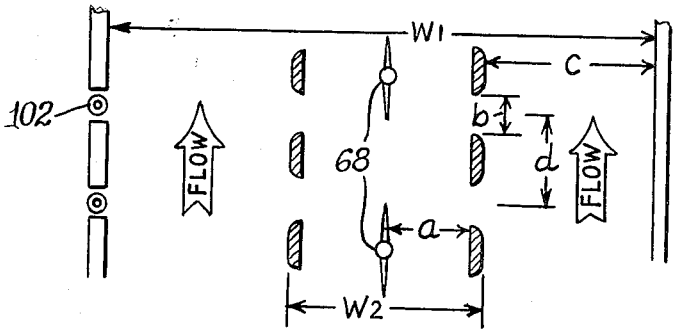
FIG. 3 is an enlarged view of a portion of the apparatus shown in FIG. 2, simplified for the sake of clarity and illustrating the relationship of certain components of the downstream region of the apparatus.

In addition to illustrating the orientation of the edges of the corona discharge element 68, FIG. 3 is also useful in describing the spatial relationships between the corona discharge elements 68, the cathode shell 30, the slots 56 and the collecting plates 24 and 26. The distance a between the edge of the element 68 when it is in the closest position relative to the slot and the inside of the shell wall is preferably about 1 inch to about 2 inches. With a shell wall thickness of about $\frac{1}{4}$ inch, the distance a of about $1\frac{1}{4}$ inches, the total shell width is about 3 inches. It is preferred that the slot width b be about $\frac{1}{2}$ inch, although it may be as small as about $\frac{1}{4}$ inch or as large as about $1\frac{1}{2}$ inch. The distance d between slots is preferably about $1\frac{1}{2}$ inches although a larger or smaller spacing within the range of about 1 inch to about 3 inches can be used. The distance d should be as small as possible without mutual corona spot quenching due to proximity shielding.

It should be appreciated that the mutual shielding provided by the adjacent corona discharge element does not occur at the endmost elements. These outer elements will be prone to excessive corona discharge and will consequently provide a high current density that can generate undesirable back corona from the collecting plates 24 and 26. Accordingly, the outer elements should be adequately shielded to reduce the corona discharge thereof to a level comparable to the main body of elements. This is done by cylindrical side support members 63 and 65 adjacent the end elements as shown in FIG. 2.

The outer shell 30 may be made of aluminum, mild steel or the like, and preferably has a thickness of about 1/16 to about $\frac{1}{4}$ inch. The outer surface of the shell 30 is preferably curved as shown at 54 because a small radius at the edge of the opening can produce sufficient field distortion to lower the breakdown strength below the optimum. This can occur particularly with a very thin-walled shell 30. If the thickness of the shell is only about 1/16 inch, the curved portions or contours 54 may be suitably pressed or deformed for increasing the radius. If the thickness of the shell is too great, the penetration of the extracting electric field into the interior of the shell will be too weak to permit sufficient ion current to be withdrawn. It should be understood that when a thick shell wall is used, the corona current can be increased, thereby improving the corona pattern, without incurring excess ion-current density on the side collecting plates 24 and 26. To do so, however, will result in some waste of power in operating the corona discharge element 68.

As shown in FIG. 7 the shell may also be a wire-mesh construction although the previously described shell with slotted openings or the like is preferred. In the event a mesh is used, it should be of a size that does not materially destroy the uniformity of the field or significantly inhibit the extraction of ions from the interior of the shell 30. It also may be desirable to use a narrow twisted metal ribbon or strip as the corona discharge member, preferably less than about ¼ inch wide, or even corona discharge wires when a mesh is used to ensure full coverage by the ion-current. With the optimum choice of mesh size, sufficient sideways spreading of the charge on the surface of the dust layer on the collecting plates 24 and 26 should occur, and provide sufficient charge pinning over the entire collecting plate area.

As the gaseous medium flows through the downstream region of the apparatus, as shown in FIG. 4, it should be understood that the entrained particles are subjected to ions that are injected into the channel through the rows of slots or openings 56. The ions will charge any uncharged dust so that it is collected on the side collecting plates 24 and 26. If reentrainment of the particles occurs, then they will again be subjected to ions from downstream rows of slots and be effectively recharged and thereafter precipitated onto the collecting plates in a similar manner. With the considerable number of rows of openings, the downstream portion of the apparatus effectively operates by charging and collecting opposite the slots, and collecting only opposite the shell where ions are not present.

The potential applied to the corona discharge elements 68 and to the ion generating means outer shell can be provided by the circuitry shown in FIG. 5 which includes respective DC power supplies 76 and 78 as shown. The power supply 76 has line 80 connected to the side collecting plates 24 and 26 and such side plates are preferably at ground potential. The negative line 82 of the power supply 76 is connected to a current limiting resistor 84 which is also connected to line 86 that extends to the ion generator shell 30 for charging the shell to the desired negative potential about −60 kV with respect to the collecting plates 24 and 26 as previously mentioned. The power supply 78 has its negative side connected to a current limiting resistor 88 via line 90 and the resistor 88 is connected to line 92 that extends to a capacitor 94 and resistor 96. The resistor 96 is connected to the corona discharge elements 68 via line 98 which is also connected to a capacitor 100. The line 98 is connected to the corona discharge elements 68 located within the shell 30 and applies the larger, more negative potential for producing the corona discharge within the shell 30. Although the potential applied to the corona discharge elements 68 is preferably well below that at which sparking occurs, there is an optimum sparking rate between the shell 30 and the collecting plates 24 and 26, and this sparking could induce sympathetic sparking inside the shell that could erode the corona discharge elements 68. However, the resistors 84 and 96 and the capacitors 94 and 100 effectively electrically decouple these two areas which enables an optimal sparking rate to occur outside the shell without inducing sparking within the shell.

In the event that sparking does occur between the corona discharge elements and the shell, it is important that it not develop into an arc. The capacitor 94 together with the resistor 88 serve to quickly quench or extinguish the arc that might occur between the corona discharge elements and the shell 30 and therby protect the corona discharge elements 68 from being eroded or severed. The time constant of the resistor 88 and capacitor 94 should also be sufficiently large that restriking of the arc does not occur. In the event the arc quenching circuit is being used in a large fly ash precipitator, the size of the capacitor may be sufficiently large that its discharge upon sparking may itself damage the corona discharge elements. This problem can be alleviated by adding inductance to the circuit.

Alternatively, damage to the corona elements in the event of an arc can be alleviated by use of a diverter circuit whereby the power is rapidly diverted by a fast acting switch until slower acting switches can interrupt the circuit.

Still another solution to this problem is to supply the corona voltage from a half-wave rectifier so that periods of zero voltage occur naturally to permit any arcs to quench. This solution can be further improved when conditions are particularly bad by selectively switching out more than one half-cycle so that the applied half-cycles of voltage occur with larger zero intervals.

To reduce the problem of back corona between the collecting plates 24 and 26 and the shell 30, the resistivity of the dust particles that accumulate on the side plates 24 and 26 may be lowered. With the rows of slots shown in FIG. 2, the resistivity of the accumulated particles may need to be lowered only in localized areas opposing the slots where back corona will most likely occur. Lowering the resistivity of the dust particles can be achieved in different ways, i.e., when the dust is fly ash, the resistivity of the dust layer can be lowered by introducing a fluid, such as steam, sulfur trioxide, ammonia or the like or by heating or cooling the collecting plate structure since the resistivity of the dust has a maximum value at about 300° F., which is close to typical operating temperatures of fly ash effluent gas.

A modification of the apparatus may include a number of tubes positioned in the side collecting plate 24 opposite the openings 56. The edge of each of the tubes is preferably aligned with the surface of the collecting plate 24 so that the general plane of the side plate is not appreciably changed which can affect the uniformity of the electric field. The use of such is disclosed in U.S. Pat. No. 4,236,900 to Fitch et al., which is hereby incorporated herein by reference. The tubes 102 are preferably made of sintered brass or other material that can withstand rapping as well as the chemical environment posed by the medium which is being put through the precipitator, and also be sufficiently porous that the steam, sulfur trioxide, ammonia or the like can be transmitted through the wall thereof.

To prevent back corona when tubes are not utilized, it is important that the maximum current density on the collecting plates 24 and 26 be limited to a few hundred nanoamps/cm$^2$ and perhaps less than ten nanoamps/cm$^2$ with very high resistivity particulates.

In accordance with another aspect of the present invention, to decrease the reentrainment of particles into the medium when the collecting plates are rapped or vibrated, ribs may be placed on the collecting plates at spaces midway between the opposing slots in the ion beam generating shell. Further, additional corona wires and/or ion beam generators may be placed downstream to decrease reentrainment.

It should be understood from the foregoing detailed description that an improved precipitating apparatus has been shown and described which achieves reliable operation at efficient power levels. The downstream region with its ion generation means is of superior design which, when used with the upstream region, results in the removal of particles at rates and efficiencies that have not been heretofore possible.

It should be understood that while certain preferred embodiments of the present invention have been illustrated and described, various modifications thereof will become apparent to those skilled in the art, and, accordingly, the scope of the present invention should be defined only by the appended claims and equivalents thereof.

Various features of the invention are set forth in the following claims.

What is claimed:

1. A system for removing particles from a gaseous medium carrying the same, comprising:

a flow channel through the system through which the gaseous medium passes in a downstream direction;

a first precipitating stage within said channel, a second precipitating stage within said channel, said second stage being located only downstream of said first stage and comprising at least one conductive shell means, each of said shell means comprising a pair of generally flat side walls, an upstream end wall interconnecting said side walls, said upstream end wall having a plurality of openings therein for admitting a flow of gaseous medium into the interior of said shell means, said shell means having a downstream end wall interconnecting said side walls and having openings therein for providing an outlet for said flow of gaseous medium, said conductive shell means having a corona discharge means located therewithin, adjacent collecting plate means associated with and spaced from said conductive shell means, the space between said side walls of said conductive shell means and said associated collecting plate means defining a pathway within said channel through which a portion of the medium passes, said conductive shell means being spaced and charged to a sufficient potential to maintain a strong generally uniform electric field between each of said conductive shell means and said associated collecting plate means, each of the side walls of said shell means having a plurality of openings therein through which ions generated by said corona discharge means can pass and enter said pathway to charge the particles of the medium located within the pathway, said openings being sufficiently large to pass enough ions therethrough to charge the particles within the pathway while not being so large so as to significantly disrupt the generally uniform electric field, said electric field driving said charged particles toward said associated collecting plate means where they are collected thereon, and said openings in said upstream and downstream end walls permitting the portion of the gaseous medium flowing through the interior of said conductive shell means, the inside surface of side walls of said conductive shell means acting as a collecting means spaced from said corona discharge means for collecting charged particles generated and located within said conductive shell means.

2. A system as defined in claim 1 wherein said upstream end of said conductive shell means includes baffles, said baffles and said openings in said upstream end of said conductive shell means dividing said gaseous medium into fractions inside said conductive shell means and outside said conductive shell means in proportion to the specific collection efficiencies within said shell and between said conductive shell means and said associated collecting plate means.

3. A system as defined in claim 1 wherein said upstream end of said conductive shell means includes baffles, said gaseous medium having a velocity which is reduced by said baffles to achieve the maximum combined collection efficiency for particles interior to said conductive shell means and exterior to said conductive shell means on said collecting plate means.

4. A system as defined in claim 1 wherein said corona discharge means located within said conductive shell means comprises a plurality of corona discharge members secured by cylindrical support members, said members being electrically insulated from said conductive shell means so that they can be charged to a potential different from the potential applied to said conductive shell means.

5. A system as defined in claim 1 wherein said corona discharge means located inside of said conductive shell means is charged to an electrical potential within the range of about −7 kV to about −20 kV relative to said conductive shell and said shell means is charged to a potential within the range of about −30 kV to about −60 kV relative to said associated collecting plate means.

6. A system as defined in claim 1 wherein said corona discharge means located inside of said conductive means is charged to an electrical potential within the range of about 7 kV to about 20 kV relative to said conductive shell means and said conductive shell means is charged to a potential within the range of about 30 kV to about 60 kV relative to said associated collecting plate means.

7. A system as defined in claim 1 wherein said associated plate means is spaced from said shell means a predetermined distance within the range of about 2 inches to about 6 inches.

8. A system as defined in claim 1 wherein said first precipitating stage comprises an electrostatic precipitator of the type which has at least one charged wire within said channel for producing corona discharge for charging particles within the gaseous medium, and at least one collecting plate spaced from said wire for collecting charged particles.

9. A system as defined in claim 2 wherein said shell means for said second precipitating stage has at least two generally parallel flat side walls, and upstream end baffles with openings therebetween said side walls at the upstream end of said conductive shell means to permit the division of said gaseous medium in proportion to the efficiencies of collecting particles on the outside of said shell and collecting particles within said conductive shell, and wherein said shell means is open between said side walls at the downstream end of said shell means to permit the flow of gaseous medium from and through said conductive shell means in the downstream direction.

10. In a system for removing particles from a gaseous medium carrying same, comprising:

a flow channel through which the gaseous medium flows from an upstream to a downstream direction;

a first precipitator stage;

a second precipitator stage within said channel downstream of said first precipitator stage wherein said second precipitator stage includes a shell means ion beam generator having a shell means and corona discharge members therewithin for creating ions within said shell means, said shell means comprising a pair of generally flat side walls which are interconnected at the upstream end of said shell means by an outwardly curved end wall to direct a portion of said gaseous medium outside said shell means, each of said end walls having openings therein to permit a portion of said gaseous medium to flow into, through and out of said shell means, said side walls of said shell means having a plurality of openings and said side walls having a voltage thereon to provide an electric field between said corona discharge members and said side walls to cause ions created by said corona discharge members to be directed toward said side walls of said shell means, a portion of said ions charging particles within said shell means and being collected on the inside surface of said side walls of said shell means and a portion of said ions passing through said openings in said side walls;

collecting plates spaced outwardly from and parallel to the side walls of said shell means, said shell means being charged to a sufficient potential to maintain a strong generally uniform field between said side walls of said shell means and said collecting plates whereby particles in said gaseous medium passing between said collecting plates and said side walls of said shell means are charged by said ions which pass through the openings in said side walls, said charged particles being drawn to said collecting plates by said electric field between said side walls and said collecting plates;

said upstream end wall of said shell means including baffles, said baffles and said openings in said upstream end wall of said shell means dividing said gaseous medium into fractions flowing inside said shell means and outside said shell means in proportion to the specific collection efficiencies within said shell means and between said shell means and said collecting plates.

11. A system as defined in claim 10 wherein said upstream of said shell means includes baffles, said gaseous medium having a velocity which is reduced by said baffles to achieve the maximum combined collection efficiency for particles interior to said shell means and exterior to said shell means on said collecting plates.

12. A system as defined in claim 10 wherein said openings in said outwardly curved end wall section are such that the division of said gaseous medium through and outside said shell means is in the same proportion as the efficiencies of collecting particles on said collecting plates and on said side walls of said shell means.

13. A system as defined in claim 10 wherein said first precipitator stage comprises an electrostatic precipitator of the type which has at least one charged wire within said flow channel for producing corona discharge for charging particles within the gaseous medium, and at least one collecting plate spaced from said wire for collecting charged particles.

14. A system as defined in claim 10 wherein precipitating means precede said first precipitator stage.

15. A system as defined in claim 10 wherein precipitating means follow said second precipitator stage.

16. A system as defined in claim 10 wherein said shell means comprises a structurally rigid electrically conductive material.

17. A system as defined in claim 10 wherein said side walls of said means shell are of an electrically conductive wire mesh construction, the spacing between wires of said mesh defining said openings.

18. A system as defined in claim 10 wherein said shell means is constructed from a material selected from the group consisting of steel and aluminum having a thickness within the range of about 1/16 inch to about $\frac{1}{4}$ inch.

19. A system as defined in claim 10 wherein said corona discharge members are rods with spikes emanating therefrom.

20. A system as defined in claim 10 wherein said corona discharge members located within said shell means are positioned therein so that they are spaced within the range of about 1 inch to about 2 inches from said shell means.

21. A system as defined in claim 10 wherein cylindrical support members are located on opposite ends of said discharge members and said support members are of increased cross-sectional size and are free from any sharp edges to reduce their proclivity to corona discharge relative to said discharge members to thereby compensate for the absence of mutual shielding produced by adjacent discharge members.

22. A system as defined in claim 10 wherein the openings in said side walls are arranged in rows that are oriented in a direction generally transverse to the direction of flow of said medium passing through said channel.

23. A system as defined in claim 22 wherein at least one of said corona discharge members is located adjacent each of said rows of openings in said side walls.

24. A system as defined in claim 22 wherein the spacing between centers of adjacent rows is within the range of about 1 inch to about 3 inches.

25. A system as defined in claim 22 wherein said openings in said side walls comprise elongated slots, the ends of which are separated by web portions of said shell means.

26. A system as defined in claim 25 wherein the web portions between adjacent slots of a row are offset relative to web portions of adjacent rows.

27. Apparatus as defined in claim 26 wherein said openings in said conductive shell means are arranged in a plurality of rows, and at least one corona discharge means is provided for each row, so that ions produced by said discharge means are adapted to pass through the openings in the associated row.

28. An apparatus as defined in claim 26 wherein said openings are elongated slots, the ends of which are separated by web portions of said shell means.

29. A system as defined in claim 25 wherein said elongated slots have a width within the range of about $\frac{1}{4}$ inch to about $1\frac{1}{2}$ inch.

30. An apparatus for precipitating particles from a gaseous medium carrying the same, comprising:

generally flat plate means upon which particles are collected;

conductive shell means spaced from said collecting plate means, the space between said shell means and said collecting plate means defining a pathway through which a portion of said medium passes, said shell means having at least two generally parallel flat side walls having a plurality of openings therein and upstream and downstream end walls interconnecting said side walls, said upstream end wall having openings for admitting a flow of gaseous medium and said downstream end wall having openings defining an outlet for said medium;

a corona discharge means located within said shell means, said means being charged to a sufficient potential to produce a corona discharge and provide a supply of ions a portion of which charge particles within said shell and a portion of said ions for passing through said openings into the pathway to charge particles outside said shell for collection of particles on said plate means;

said shell means being charged to a potential sufficient to maintain a strong generally uniform electric field between said shell means and said collecting plate means and said openings in said side walls being sufficiently large to pass enough ions therethrough to charge the particles while not so large so as to significantly disrupt the generally uniform electric field, said electric field influencing said charged particles toward said plate means where they are collected thereon;

said shell means being a collecting plate spaced from said corona discharge members for collecting charged particles on the inside surface of said shell means; and said conductive shell means includes baffles in the upstream end wall, said baffles dividing said gaseous medium into fractions flowing into said flow conduit inside said conductive shell means and into said pathway outside said conductive shell means in proportion to the specific collection efficiencies within said flow conduit and within said pathway.

31. An apparatus as defined in claim 30 wherein said shell means comprises a structurally rigid electrically conductive material.

32. An apparatus as defined in claim 30 wherein said conductive shell means includes baffles, said gaseous medium having a velocity which is reduced by said baffles to achieve the maximum combined collection efficiency for particles within said flow conduit and within said pathway.

* * * * *